US007151903B2

(12) United States Patent
Wu et al.

(10) Patent No.: US 7,151,903 B2
(45) Date of Patent: Dec. 19, 2006

(54) METHOD AND APPARATUS FOR REDUCING SURFACE TEMPERATURE VARIATION OF AN EXTERNALLY-HEATED FUSING ROLLER

(75) Inventors: Fangsheng Wu, Lexington, KY (US); R. Scott Lockhart, Webster, NY (US); Muhammed Aslam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 182 days.

(21) Appl. No.: 10/921,736

(22) Filed: Aug. 19, 2004

(65) Prior Publication Data

US 2006/0039712 A1 Feb. 23, 2006

(51) Int. Cl.
*G03G 15/20* (2006.01)

(52) U.S. Cl. ..... 399/69

(58) Field of Classification Search ..... 399/38, 399/67, 69, 70, 107, 122, 320, 328, 329, 399/330; 219/216
See application file for complete search history.

(56) References Cited

U.S. PATENT DOCUMENTS 6,052,546 A * 4/2000 Aslam ..... 399/70
6,289,185 B1 * 9/2001 Cahill ..... 399/69
6,411,785 B1 * 6/2002 Ogawahara et al. ..... 399/69
6,490,430 B1 * 12/2002 Chen et al. ..... 399/333
6,567,641 B1 * 5/2003 Aslam et al. ..... 399/330
6,582,222 B1 * 6/2003 Chen et al. ..... 432/60
6,611,670 B1 * 8/2003 Chen et al. ..... 399/328
6,835,918 B1 * 12/2004 Kagawa et al. ..... 219/469

* cited by examiner

*Primary Examiner*—Hoan Tran
(74) *Attorney, Agent, or Firm*—Lawrence P. Kessler

(57) ABSTRACT

Reducing variation in the surface temperature of an externally-heated fusing roller in an electrophotographic machine, the variation typically occurring during the beginning of a fusing run, by detecting the beginning of a fusing run and applying a modified fusing temperature set-point characteristic to the fusing roller. The mode of the electrophotographic machine is monitored to determine whether the machine has changed operating modes, and the application of the modified fusing temperature set-point characteristic to the fusing roller is ceased when the electrophotographic machine changes modes. The force with which the heating rollers engage the fusing roller is controlled within desired operating limits.

35 Claims, 8 Drawing Sheets

METHOD AND APPARATUS FOR REDUCING SURFACE TEMPERATURE VARIATION OF AN EXTERNALLY-HEATED FUSING ROLLER

FIELD OF THE INVENTION

The present invention relates generally to electrophotographic copying and/or printing machines, and more particularly to such machines having an externally heated fuser. Even more particularly, the present invention relates to a method and apparatus for reducing short-term and long-term variation in the fusing temperature of an electrophotographic machine having an externally heated fusing roller.

BACKGROUND OF THE INVENTION

Electrophotographic machines, such as, for example, copiers and printers, produce images by forming a latent image charge pattern on a photoconductive surface. The photoconductive surface carries the latent image through a developing station wherein pigmented toner particles are drawn by electrostatic attraction onto the latent image charge pattern on the photoconductive surface. An electric field is applied to transfer the image from the photoconductive surface onto either an intermediate transfer member or an image substrate, such as, for example, a piece of paper. Thereafter, the image is fixed, such as, for example, by fusing, to the image substrate. The fusing process applies heat and pressure to the image substrate, and is typically carried out by a fusing nip formed between a heated fusing roller and an opposing pressure roller. The fusing roller may be internally or externally heated, or some combination thereof.

The heat applied to an internally heated fusing roller must diffuse through the roller and its outer surface. Since heat is applied directly to the outer surface of an externally heated roller, the need for heat to diffuse through the roller and its outer surface is eliminated. Externally heated fusing rollers, therefore, have a much faster thermal response than internally heated fusing rollers. Accordingly, an externally heated fusing roller can typically be heated to a given operating temperature more rapidly and can employ a thicker outer cushioning layer to improve the efficiency and reliability with which paper releases from the fusing roller.

However, externally heated fusing rollers are disadvantageous in that the roller itself does not act as a heat reservoir to the same extent that internally-heated fusing rollers do. Therefore, at least during the first few fusing operations, an undesirable and sharp reduction in the temperature of the fusing roller surface may occur due to the significant amount of heat that is transferred from the fusing roller surface to the image substrate. This short-term reduction in the surface temperature of the fusing roller will be especially pronounced during the first few fusing operations, i.e., the fusing operations that occur during the delay from the time at which the reduction in the fusing roller surface temperature is first sensed to the time at which the fusing roller surface is returned to nominal temperature. This short-term reduction in fusing roller surface temperature is undesirable in that one or more image substrates may be exposed to fusing process parameters that are less than optimal/nominal.

Therefore, what is needed in the art is an improved method for controlling the surface temperature of an externally heated fusing roller.

Furthermore, what is needed in the art is a method that reduces the pronounced reduction in the temperature of the surface of an externally heated fusing roller that may occur during the initial operation thereof.

The fusing roller surface temperature is also subjected to longer-term temperature variation due to various factors, including electrical noise, variations in image substrate or media thickness and/or weight, and diffusion of heat from the internal lamp to the fusing roller surface. Conventionally, such long-term variation in fusing roller surface temperature is compensated for by a control method, such as a proportional integration derivative method that adjust the power applied to the heating rollers and/or the force with which the heating rollers engage the fusing roller. However, such conventional control methods may result in undesirable operating conditions, such as, for example, wherein the heating roller engages the fusing roller with zero engagement force or maximum engagement force.

Thus, what is needed in the art is an improved method of controlling fusing roller surface temperature.

SUMMARY OF THE INVENTION

The present invention provides a method and apparatus for reducing the variation in the surface temperature of an externally heated fusing roller that typically occurs during the beginning of a fusing run, and of controlling within desired limits the force with which the heating roller(s) engages the fusing roller.

An advantage of the present invention is that the dip that typically occurs in fusing roller surface temperature during the beginning of a fusing run is substantially reduced.

The invention includes, in one form thereof, a method that includes detecting the beginning of a fusing run and applying a modified fusing temperature set-point characteristic to the fusing roller. The mode of the electrophotographic machine is monitored to determine whether the machine has changed operating modes, and the application of the modified fusing temperature set-point characteristic to the fusing roller is ceased when the electrophotographic machine changes modes. The force with which the heating rollers engage the fusing roller is controlled within desired operating limits.

An advantage of the present invention is that the dip that typically occurs in fusing roller surface temperature during the beginning of a fusing run is substantially reduced.

A further advantage of the present invention is that long-term control of the fusing roller surface temperature is achieved without disengagement of the heating roller from the fusing roller and/or maximum engagement of the heating roller with the fusing rollers.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE DRAWINGS

Figure 1:
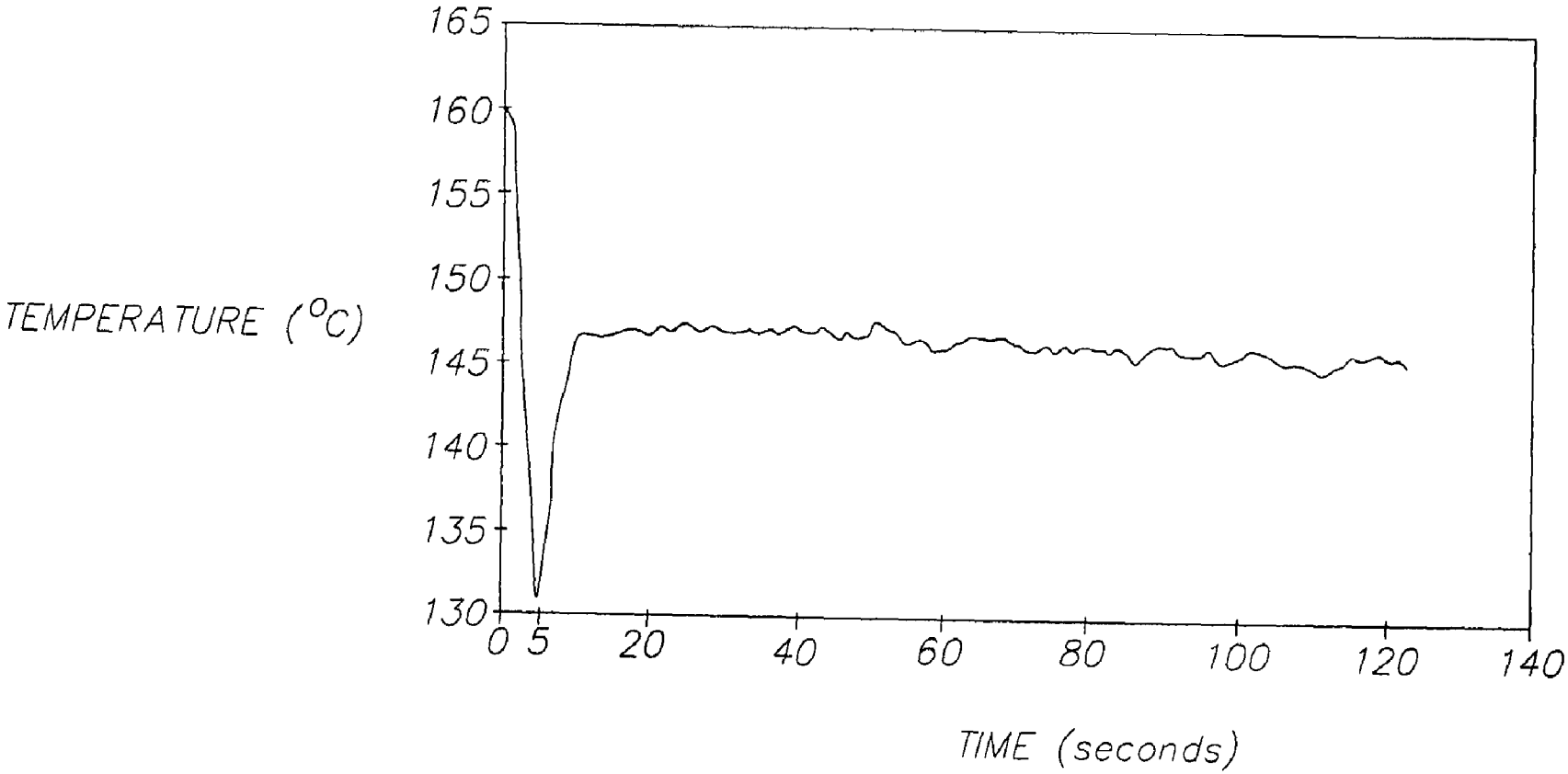
FIG. 1 is a plot of fusing roller surface temperature versus time in an exemplary conventional electrophotographic machine having an externally heated fusing roller.

Referring now to the drawings, and particularly to FIG. 1, there is shown a plot of the temperature of the fusing roller surface versus time in seconds for an exemplary conventional electrophotographic machine having an externally heated fusing roller. At time t=0, a first image substrate is fed into the fusing nip, i.e., the interfacial area formed between the fusing roller and pressure roller, of the conventional machine. Heat is transferred from the fusing roller to the first image substrate, and as subsequent image substrates are processed through the fusing nip additional heat is transferred from the fusing roller to each image substrate.

The heat transfer from the fusing roller to the image substrates is reflected by a reduction or dip in the temperature of the fusing roller surface beginning at approximately time t=1. As shown, the fusing roller surface temperature is maximally reduced at approximately time t=5 and thereafter increases toward and reaches a nominal value of approximately 146–147° C. at approximately t=10. It should be understood that the fusing roller surface temperature characteristic plotted in FIG. 1 is exemplary, and that the temperature characteristics of conventional electrophotographic machines may vary and depart therefrom.

Generally, electrophotographic machines having externally heated fusing rollers and using conventional temperature control methods will typically exhibit a dip in the fusing roller surface temperature during the first few seconds of fusing operation similar to that illustrated in FIG. 1. Such a dip is due, at least in part, to conventional fusing temperature control methods targeting a fusing temperature set-point that is approximately equal to the nominal fusing temperature. Such a dip is also due, at least in part, to the time required for the fusing temperature control methods and devices used in conventional electrophotographic machines to sense, react to, and compensate for the reduction from the nominal fusing temperature that occurs during the first few seconds of fusing operation.

In contrast, the present invention anticipates, rather than reacts to, the above-described reduction in the surface temperature of an externally-heated fusing roller that occurs during the initial stages of fusing roller operation. Generally, this is accomplished by setting the fusing temperature set-point to a predetermined value above the nominal fusing temperature. More particularly, the present invention applies a modified temperature characteristic to the fusing roller during the initial stages of its operation to thereby counteract the reduction in fusing roller temperature that would otherwise occur.

Figure 2:
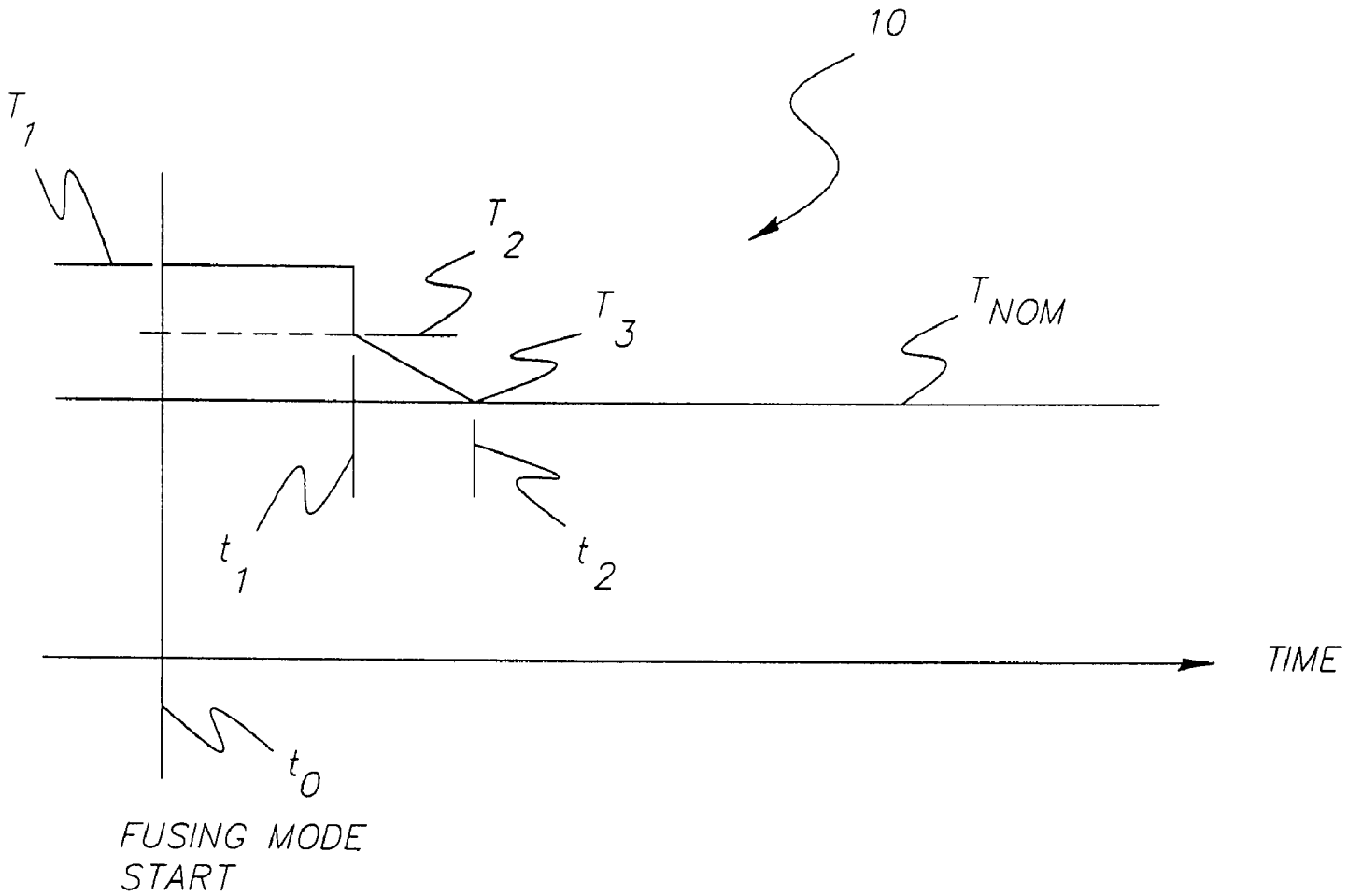
FIG. 2 is a plot of a generalized fusing roller temperature set-point characteristic provided by the method of applying a modified fusing roller set-point temperature characteristic of the present invention.

Referring now to FIG. 2, a modified fusing temperature set-point characteristic (MFTSC) of the present invention is shown. MFTSC 10 applies to the fusing roller a first temperature $T_1$ above the nominal fusing temperature $T_{NOM}$, from time $t_0$ to time $t_1$, and applies a temperature function that decreases from temperature $T_2$ at time $t_1$ to temperature $T_3$ at time $t_2$. Thereafter, i.e., subsequent to time $t_2$, an unmodified or conventional fusing temperature set-point characteristic is applied to the fusing roller to maintain the fusing roller at a nominal fusing temperature $T_{NOM}$.

Times $t_1$ and $t_2$ and temperatures $T_1$, $T_2$ and $T_3$ are dependent at least in part upon the type and characteristics of the image substrate being fused and the speed with which that image substrate is processed through the fusing operation. Generally, if machine speed is fixed, one set of fusing process parameters for temperatures $T_1$, $T_2$ and $T_3$ and times $t_1$ and $t_2$ is suitable for and will be applied to each paper type or paper family.

For example, when the image substrate is a standard-weight paper, temperature $T_1$ is approximately from 0–20° C. greater than nominal fusing temperature $T_{NOM}$, temperature $T_2$ is from approximately 0–20° C. greater than nominal fusing temperature $T_{NOM}$, temperature $T_3$ is approximately equal to nominal fusing temperature $T_{NOM}$, and times $T_1$ and $T_2$ are from approximately 1–60 seconds. Preferably, and as a further example, temperature $T_1$ is from approximately 0–10° C. greater than nominal fusing temperature $T_{NOM}$, temperature $T_2$ is from approximately 0–10° C. greater than nominal fusing temperature $T_{NOM}$, temperature $T_3$ is substantially equal to nominal fusing temperature $T_{NOM}$, and times $t_1$ and $t_2$ are from approximately 1–10 seconds. The rate at which the fusing roller temperature is reduced from temperature $T_2$ to temperature $T_3$ is generally linear or, alternatively, is tailored to the specific characteristics of the machine applying MFTSC 10, and/or the type of paper being processed.

Figures 6, 6A:
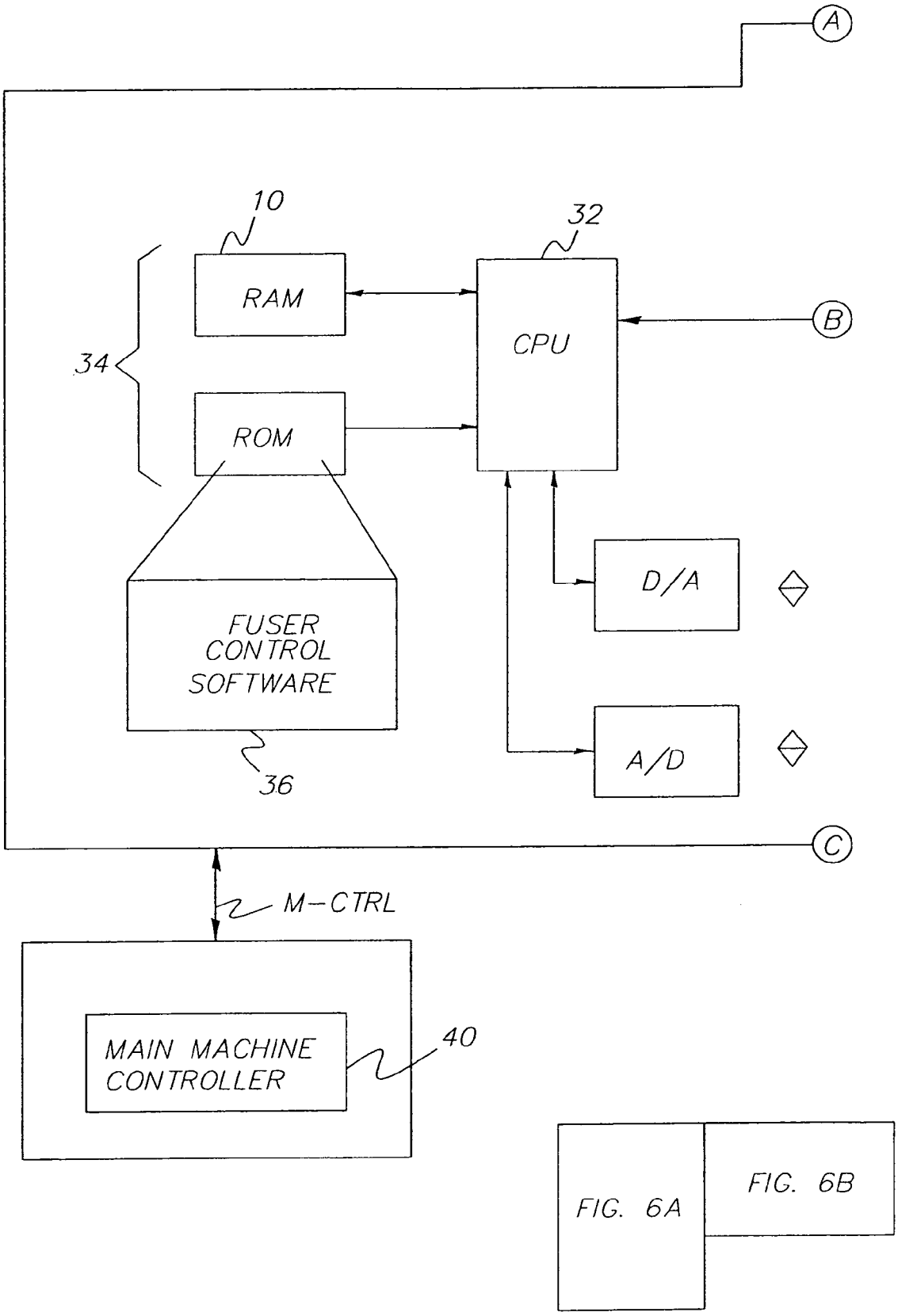
FIGS. 6, 6*a*, 6*b* represent a block diagram of an electrophotographic machine fuser including one embodiment of a fusing temperature control system of the present invention.
Figure 6B:
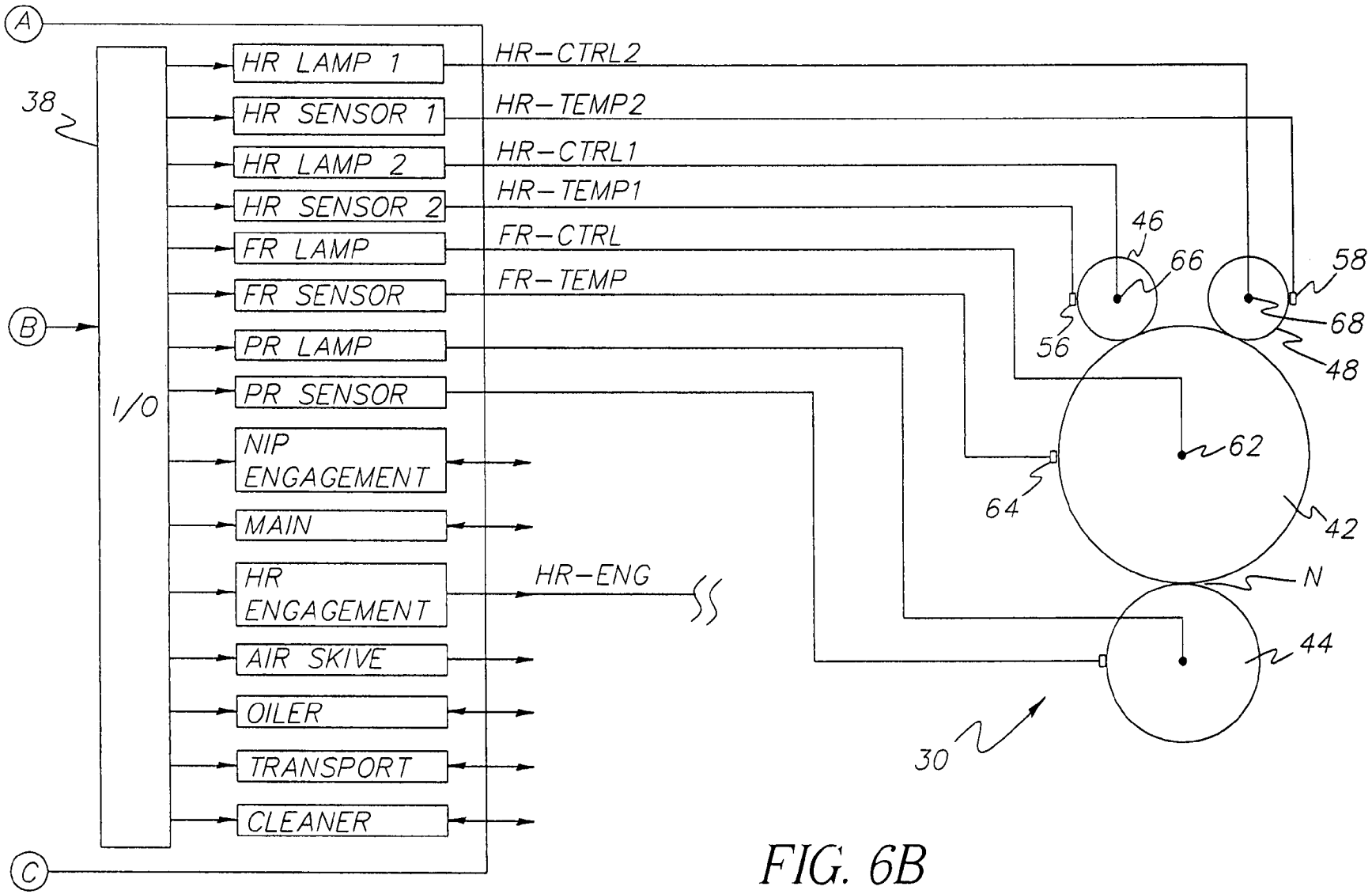

MFTSC 10 is applied to, and the method of the present invention is performed within, an electrophotographic printing machine such as the exemplary electrophotographic machine fuser shown in FIGS. 6, 6A, and 6B. The electrophotographic machine fuser includes fusing station 30, fusing station controller 32 including a centrol processing unit (CPU), memory 34, fuser control software 36, input/output (I/O) circuitry 38, and is electrically connected to a main machine controller 40.

Fusing station 30 includes fusing roller 42, pressure roller 44, external heating rollers 46 and 48, heating roller sensors 56 and 58, internal heating element 62, and fusing roller sensor 64. Fusing roller 42 and pressure roller 44 are conventional fusing and pressure rollers, and are disposed in opposing relation to form therebetween a fusing nip N, as is known and conventional in the art. External heating rollers 46 and 48 respectively include heating elements 66 and 68, such as, for example, lamps, and are disposed in adjustable engagement with and heat the outer surface of fusing roller 42. Heating roller sensors 56 and 58 are associated with and sense the temperature of the outer surface of heating rollers 46 and 48, respectively. Heating roller sensors 56 and 58 issue sense signals HR_TEMP1 and HR_TEMP2 which are indicative of the temperature of the outer surface of heating rollers 46 and 48, respectively.

Internal heating element 62, such as, for example, a lamp, is disposed within fusing roller 42. At least one fusing roller sensor 64 is associated with and senses the temperature of the outer surface of fusing roller 42. Fusing roller sensor 64 issues sense signal FR_TEMP, which is indicative of the temperature of the outer surface of fusing roller 42.

Fusing station controller 32 is a conventional controller, such as, for example, a microprocessor, and generally controls the operation of fusing station 30. Fusing station controller 32 is electrically interconnected via I/O circuitry 38 with each of heating elements 66 and 68, heating roller sensors 56 and 58, internal heating element 62, and fusing roller sensor 64. More particularly, fusing station controller 32 issues control signals HR_CTRL1 and HR_CTRL2 to heating elements 66 and 68, respectively, and issues control signal FR_CTRL to heating element 62. Fusing station controller 32 also issues control signal HR_ENG to control the force with which heating rollers 46 and 48 engage fusing roller 42. The force with which heating rollers 46 and 48 engage heating roller 42 is controlled by one of several mechanisms known in the art, such as, for example, digital or stepper motors (not shown) that move heating rollers 46 and 48 in a direction generally toward and/or away from heating roller 42 in response to HR_ENG signal. Fusing station controller 32 receives sensor signals HR_TEMP1 and HR_TEMP2 from heating roller sensors 56 and 58, respectively, and sensor signal FR_TEMP from fusing roller sensor 64. Fusing station controller 32 is also electrically interconnected with memory 34.

Memory 34 includes random access memory (RAM), such as, for example, dynamic RAM and/or other suitable forms of RAM as are known, and read only memory (ROM), such as, for example, non-volatile memory circuitry. Memory 34 is accessible by fusing station controller 32 for the retrieval and/or storage of information/data. Fuser control software 36 and MFTSC 10 are stored within memory 34.

Fuser control software 36 generally includes the instructions that control the operation of electrophotographic machine fuser and the various functions thereof. As is more particularly described hereinafter, fuser control software 36 also includes the control for applying a modified fusing roller temperature characteristic of the present invention.

Input/Output circuitry 38 includes conventional circuitry, including signal input/output buffers, digital-to-analog converters, analog-to-digital converters, digital input/output devices, etc., that enable fusing station controller 32 to communicate and exchange signals with the various systems and sub-systems of electrophotographic machine.

Main machine controller 40 is a conventional controller, such as, for example, a microprocessor, and generally controls the operation of electrophotographic machine. Main controller 40 issues a plurality of main control signals M_CTRL to fusing station controller 32, including signals that enable fusing station 30 to determine the mode of operation of electrophotographic machine. Such signals, as is known in the art, include signals indicative of the position of an image substrate within electrophotographic machine and/or fusing station 30, and signals indicative of sheet count and/or timer signals indicating the duration of a particular operating mode or event. Such signals are collectively referred to hereinafter as main control signals M_CTRL.

Figure 3:
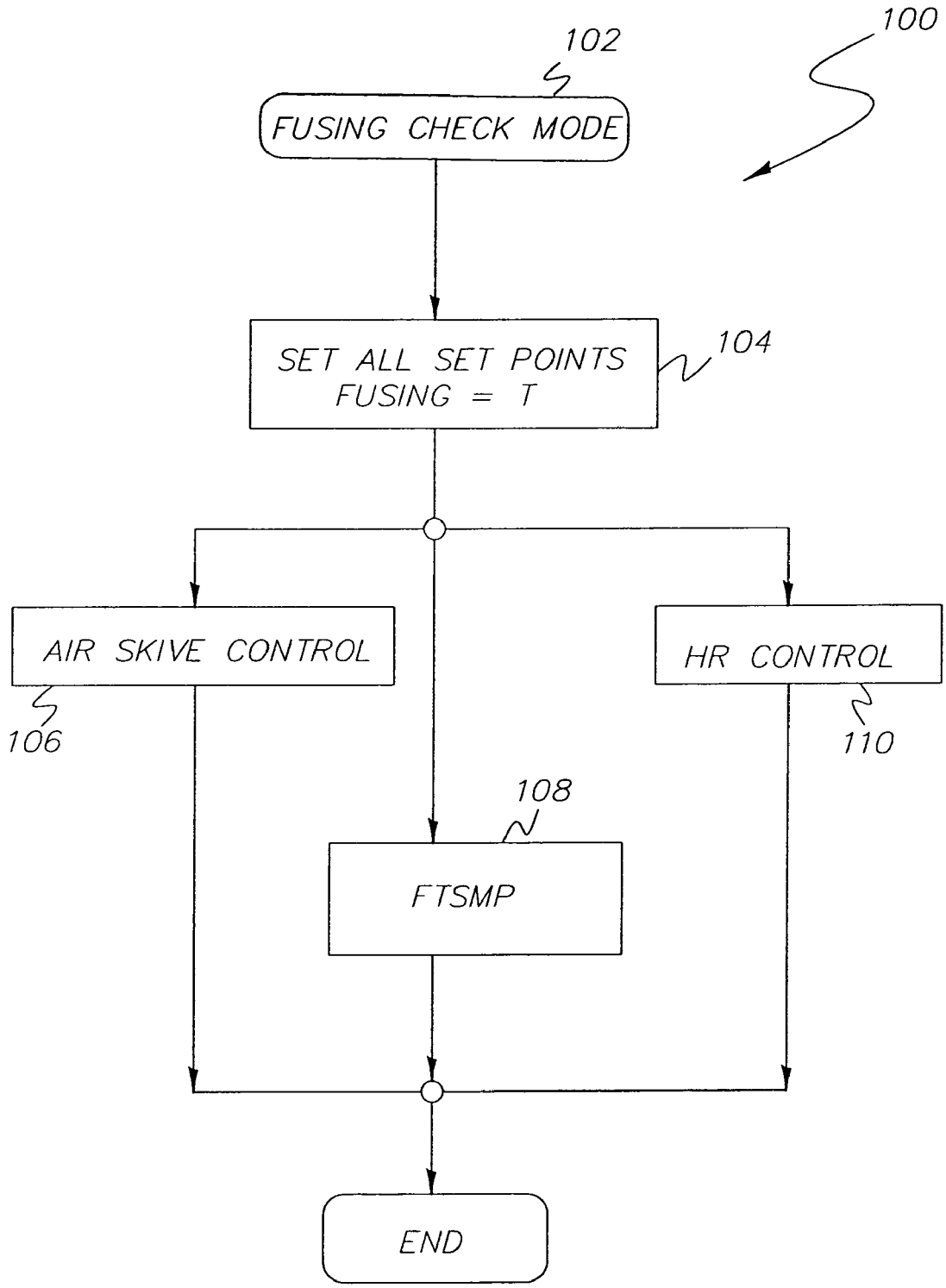
FIG. 3 is a flow diagram of one embodiment of a method for applying a modified fusing roller temperature set-point characteristic and a heating roller engagement control process of the present invention.

Referring now to FIG. 3, a flow diagram of one embodiment of a method for applying a modified fusing roller temperature characteristic of the present invention is shown. Generally, method 100 is embodied within, and is performed by fusing station controller 32 executing, fuser control software 36. Method 100 includes the process steps of fusing mode check 102, setting initial fusing temperature set points 104, air skive control 106, fusing temperature set-point modification process 108, and heating roller engagement control 110.

Fusing mode check 102 includes the process of fusing system controller 32 checking the status of main control signals M_CTRL to determine whether electrophotographic machine is operating in the fusing mode, i.e., an image substrate is either in or very nearly in fusing nip N. If 102 it is determined that electrophotographic machine is operating in the fusing mode, and not, for example, in the standby, sleep or ready modes, method 100 executes the process of setting initial fusing process set-points 104.

Setting initial fusing process set-points 104 includes fusing station controller 32 setting to nominal or substantially nominal values the fusing process control parameter set-points, including times and temperatures, that are monitored by fusing station controller 32 to control the fusing process. The nominal fusing temperature set-points are either retrieved from memory 34 or from main machine controller 40 by fusing station controller 32 and plugged into, or are included as default data within, fuser control software 36. Thus, a nominal or substantially nominal fusing temperature characteristic is applied to fusing station 30, and the fusing process occurs at nominal or substantially nominal process parameters. Once the nominal fusing temperature characteristic has been established and set, method 100 proceeds to fusing temperature set-point modification process (FTSMP) 108.

FTSMP 108, in general, applies modified fusing temperature set-point characteristic MFTSC 10 to fusing station 30 when predefined operating conditions exist in order to counteract the reduction in the temperature of the outer surface of fusing roller 42 that would otherwise occur.

Figure 4:
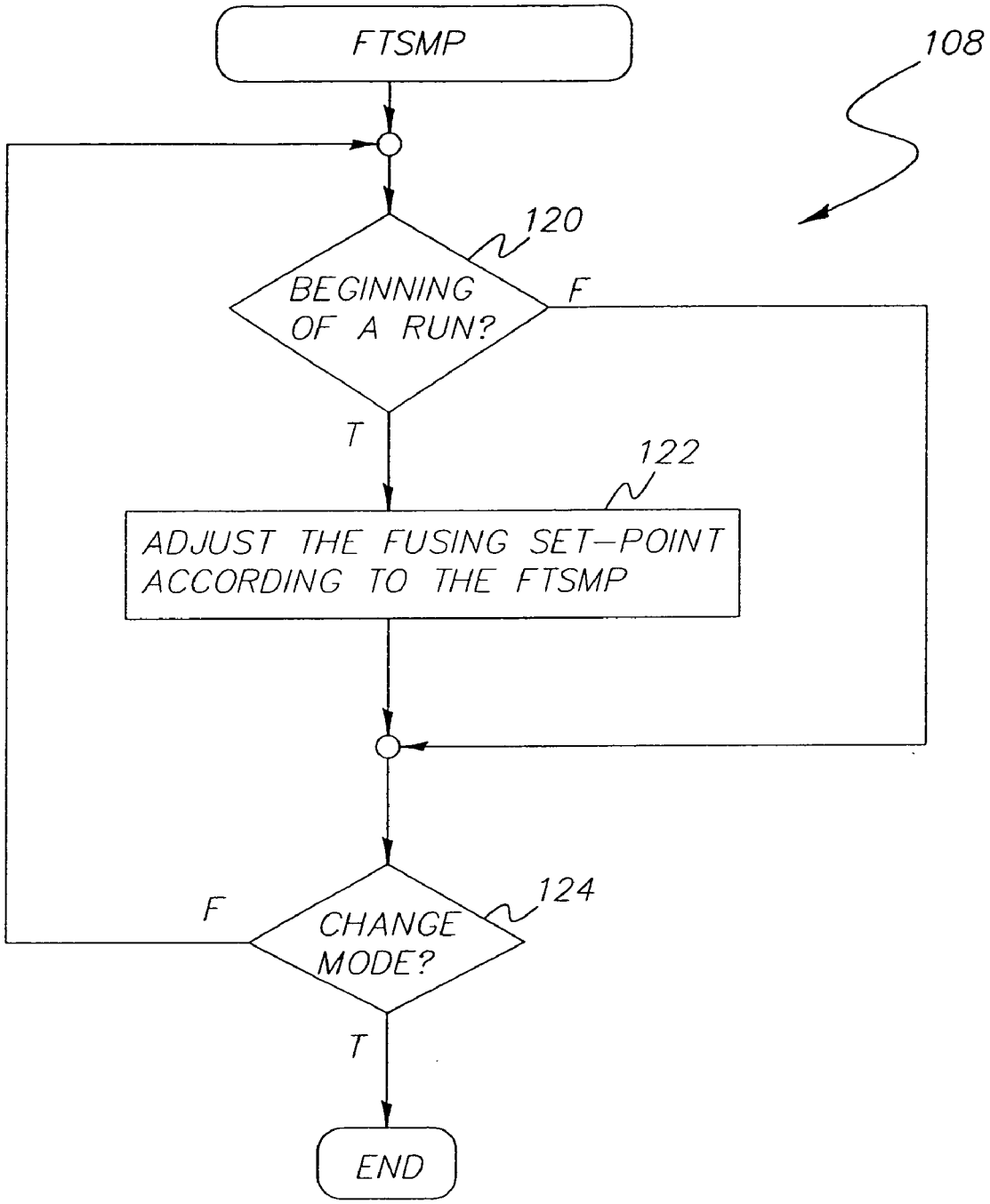
FIG. 4 is a flow diagram of one embodiment of the fusing temperature set-point characteristic adjustment/modification process of FIG. 3.

More particularly, and as shown in FIG. 4, FTSMP 108 includes a beginning run check 120, applying modified fusing temperature set-points 122, and mode monitoring process 124. Beginning run check 120 determines whether fusing station 30 is at or near the beginning of a run of documents to be fused.

The beginning of a run for the purposes of the present invention includes and is defined as including the period of time during which the temperature of fusing roller 42 would, without modification of the fusing temperature characteristic, be suddenly reduced and undergo a sudden change similar to that shown in FIG. 1. This period of time typically includes, for example, the time during which the first 5–10 documents are processed through fusing station 30. Alternatively, the beginning of a run includes, for example, the first 5–10 seconds of operation of fusing station 30. Further, the beginning of a run also requires that the fusing station be in an operational mode and not in a standby, sleep or ready mode.

The execution of beginning run check 120 includes fusing station controller 32 reading main control signals M_CTRL and checking the status thereof in order to determine whether fusing station 30 and/or electrophotographic machine is at or near the beginning of a fusing run. When beginning run check 120 determines that fusing station 30 is at or near the beginning of a run of documents to be fused, FTSMP 108 proceeds to and executes the step of applying modified fusing temperature set-points 122. Conversely, when beginning run check 120 determines that fusing station 30 is not at or near the beginning of a run, FTSMP 108 executes mode monitoring process 124.

The execution of applying modified fusing temperature set points 122 includes fusing station controller 32 applying the parameters of MFTSC 10 described above, e.g., temperatures $T_1$, $T_2$ and $T_3$ and times $t_1$ and $t_2$, as modified set-points and/or process control points for use by fuser control software 36 for controlling the fusing process. The parameters of MFTSC 10 are either stored in memory 34 and read therefrom by fusing station controller 32 executing fuser control software 36, or are directly incorporated within the fuser control software 36. Thus, rather than being controlled to nominal values, the fusing process is instead controlled to the modified fusing process control parameters of MFTSC 10.

More particularly, fusing station controller 32 sets control signals HR_CTRL1, HR_CTRL2, and FR_CTRL to correspond to the parameters of MFTSC 10. Heating elements 66 and 68, responsive to and dependent at least in part upon control signals HR_CTRL1 and HR_CTRL2, respectively, apply heat indirectly to and thereby heat the outer surface of heating rollers 46 and 48, which are in adjustable engagement with the outer surface of fusing roller 42, to a modified temperature corresponding to the control signals. The heat applied by heating elements 66 and 68 to the outer surfaces of heating rollers 46 and 48 is transferred to the outer surface of fusing roller 42 by contact or engagement with heating rollers 46 and 48. Heating element 62, responsive to and dependent at least in part upon control signal FR_CTRL, maintains the inner core of fusing roller 42 at a desired temperature corresponding to control signal FR_CTRL in order to reduce heat transfer from the outer surface of fusing roller 42 to its inner core, which reduces the load upon heating rollers 46 and 48.

Fusing station controller 32 also monitors sensor signals HR_TEMP1, HR_TEMP2, and FR_TEMP to ensure heating rollers 46 and 48 and fusing roller 42, respectively, achieve the temperatures corresponding to control signals HR_CTRL1, HR_CTRL2, HR_ENG and FR_CTRL, and makes necessary adjustments in those control signals to ensure that temperatures $T_1$, $T_2$ and $T_3$ and times $t_1$ and $t_2$ are in substantial conformance, i.e., within acceptable tolerance limits, with the parameters of MFSTC 10.

Mode monitoring process 124 includes determining whether a mode change has occurred in the operating mode or conditions of fusing station 30. If no change has occurred in the operating mode of fusing station 30, FTSMP 108 loops back to and again executes beginning run check 120. Conversely, if a change in the operating mode of fusing station 30 has occurred, FTSMP 108 terminates.

The execution of mode monitoring process 124 includes the execution of fuser control software 36 by fusing station controller 32 to monitor main control signals M_CTRL to determine whether some other event, such as user input or job interrupt, has taken place to remove fusing station 30 from operating conditions corresponding to the beginning of a run. Mode monitoring process 124 continuously checks to see whether a mode change has occurred.

Air skive control 106 (FIG. 3) is a process that occurs simultaneously and in parallel with FTSMP 108, and also heating roller engagement control 110. Generally, air skive control 106 facilitates the release of an image substrate or sheet of paper from fusing roller 42 by directing a flow of air toward fusing roller 42, as is known in the art.

Figure 5:
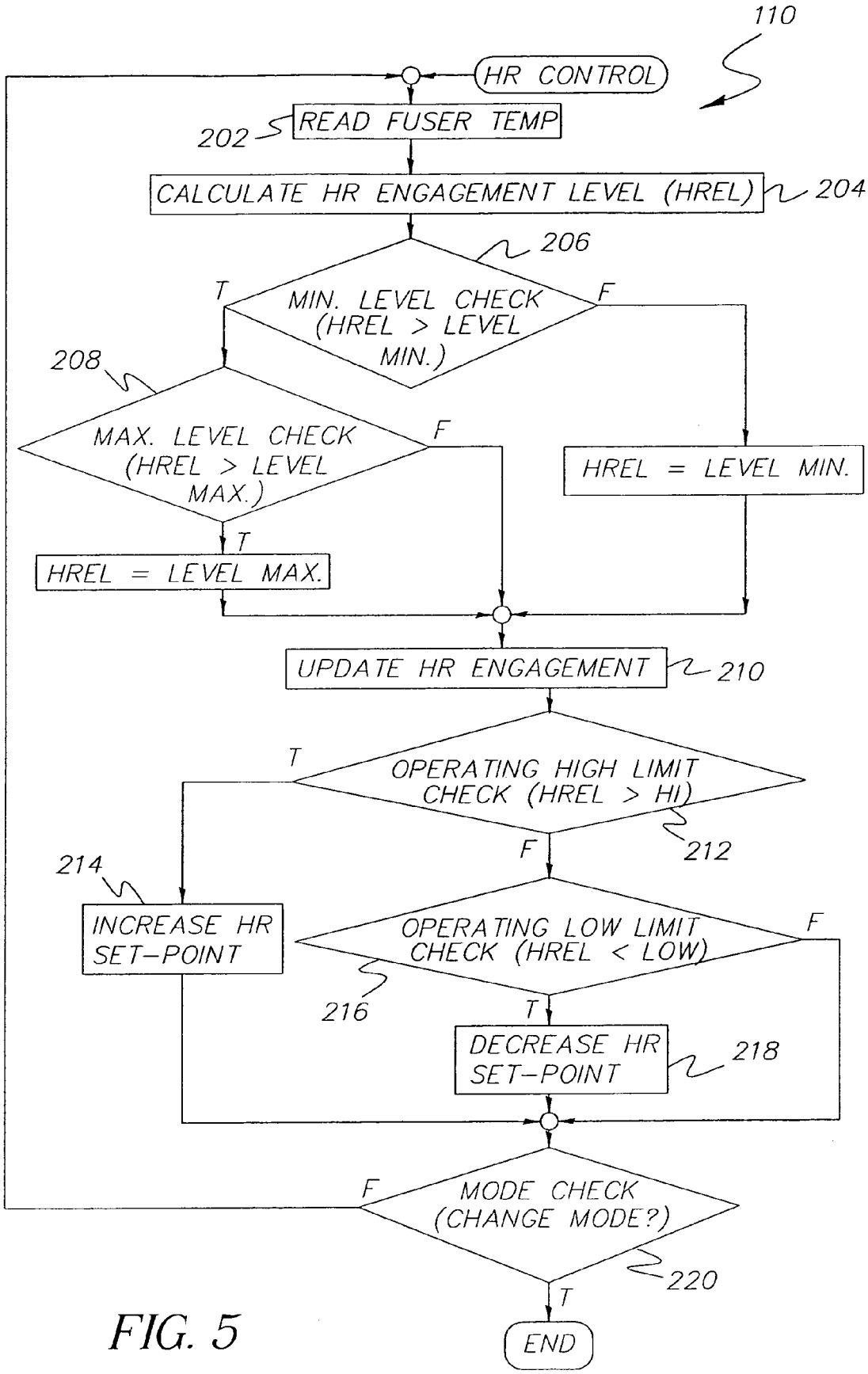
FIG. 5 is a flow diagram of one embodiment of the heating roller temperature and engagement control process of FIG. 3.

Referring now to FIG. 5, a flow diagram of one embodiment of the heating roller engagement control process 110 of FIG. 3 is shown. Generally, heating roller engagement control process 110 adjusts within predefined limits the degree to which heating rollers 46 and 48 are engaged with fusing roller 42 and thereby controls the amount of heat that is transferred from heating rollers 46 and 48 to fusing roller 42. In the event that the degree to which heating rollers 46 and 48 are engaged with fusing roller 42 falls outside the predefined limits, heating roller engagement control process 110 adjusts the temperature of heating rollers 46 and 48 to maintain the engagement within the predefined limits and maintain fusing roller 42 at the desired temperature.

It should be particularly noted that heating roller engagement control process 110 is a process that is executed in parallel or contemporaneously with FTSMP 108, and thus heating roller engagement control process 110 is executed whether or not FTSMP 108 is executed. Heating roller engagement control process 110 is executed during the execution of FTSMP 108, which occurs only at the beginning of a run, and during other times when the fusing operation is being carried out at nominal (unmodified) fusing temperature set points. Thus, heating roller engagement control process 110 is executed and controls heating roller engagement on both a short and long-term basis.

Heating roller engagement control process 110 includes the processes of read fuser temp 202, calculate heating roller engagement level 204, minimum level check 206, maximum level check 208, update heating roller engagement level 210, operating high limit check 212, increase heating roller set-point 214, operating low limit check 216, decrease heating roller set-point 218, and mode check 220.

Read fuser temp 202 is executed by fusing station controller 32 executing an application of fuser control software 36 and reading the surface temperature of fusing roller 42 as indicated by sensor signal FR_TEMP that is issued by fusing roller sensor 64, as discussed above. Calculate heating roller engagement level 204 includes the comparison by fusing station controller 32 of the sensed value of the surface temperature of fusing roller 42 obtained in read fuser temp 202 to the current set-point or desired temperature for the surface of fusing roller 42. Dependent at least in part on that comparison, calculate heating roller engagement level 204, executed by fusing station controller 32, calculates a heating roller engagement level that is indicative of and/or corresponds to the amount of force with or degree to which heating rollers 46 and 48 must engage fusing roller 42 in order to raise or lower the sensed surface temperature of fusing roller 42 to the current set-point or desired temperature. Generally, the heating roller engagement level is proportional to the degree or force with which heating rollers 46 and 48 engage fusing roller 42.

Minimum level check 206 includes the comparison of the heating roller engagement level previously calculated in calculate heating roller engagement level 204 with a predetermined minimum limit, such as, for example, zero percent or zero engagement force. If the calculated heating roller engagement level is greater than the minimum limit, heating roller engagement control process 110 proceeds to and executes maximum level check 208. If the calculated heating roller engagement level is not greater than the minimum limit, the updated heating roller engagement level is assigned or set to the minimum limit/value during the execution of update heating roller engagement level 210.

Maximum level check 208 includes the comparison of the heating roller engagement level previously calculated in calculate heating roller engagement level 204 with a predetermined maximum limit, such as, for example, one-hundred percent of a maximum engagement force. If the calculated heating roller engagement level is less than or equal to the maximum limit, heating roller engagement control process 110 sets the updated heating roller engagement level to the level calculated in calculate heating roller engagement level 204 during the execution of update heating roller engagement level 210. If the calculated heating roller engagement level 204 is greater than the maximum limit, heating roller engagement control process 110 assigns or sets the updated heating roller engagement level to that maximum limit/value during the execution of update heating roller engagement level 210.

Update heating roller engagement 210 is conducted by fusing station controller 32 executing an application of fuser control software 36 and issuing heating roller engagement control signal HR_ENG that is indicative of the value of the updated heating roller engagement level determined by calculate heating roller engagement level 204, minimum level check 206 and maximum level check 208, as discussed above. Dependent at least in part upon and responsive to control signal HR_ENG, the engagement of heating rollers 46 and 48 with the surface of fusing roller 42 is adjusted. Although shown as a single control signal, it is to be understood that a separate and respective heating roller engagement control signal HR_ENG can be issued to each of the heating roller engagement-adjusting devices (not shown) to thereby adjust the force with which each of the heating rollers 46 and 48 engage fusing roller 42.

Operating high limit check 212 is then conducted by fusing station controller 32 executing an application of fuser control software 36. Operating high limit check 212 compares the value of heating roller engagement applied to heating rollers 46 and 48 in update heating roller engagement 210 to a predetermined maximum desired operating limit, which can be the same or less than the maximum limit used in maximum level check 208. If the heating roller engagement level exceeds the maximum desired operating limit, increase heating roller set-point process 214 is executed, wherein the operating high limit is less than or equal to ninety-nine percent of the maximum level, and preferably, less than or equal to ninety-nine percent of the maximum level. If, however, the heating roller engagement level does not exceed the maximum desired operating limit, operating low limit check 216 is conducted.

Similarly, operating low limit check 216 is conducted by controller 32 executing an application of fuser control software 36. Operating low limit check 216 compares the value of heating roller engagement applied to heating rollers 46 and 48 in update heating roller engagement 210 to a predetermined minimum desired operating limit for the heating roller engagement. The minimum desired operating limit can be the same or larger than the minimum limit used in minimum level check 206. If the heating roller engagement level exceeds the minimum desired operating limit mode check 220 is executed. If the heating roller engagement level is less than the minimum desired operating limit, decrease heating roller set-point process 218 is executed prior to the execution of mode check 220, wherein the operating low limit is greater than or equal to twenty percent of the maximum level, and preferably, greater than or equal to eighty percent of the maximum level.

By comparing the values of heating roller engagement determined in update heating roller engagement 210 against desired high and low operating limits undesirable operating conditions, such as a zero or maximum engagement levels between the heating and fusing rollers, are avoided.

Mode check 220 is conducted by fusing station controller 32 executing an application of fuser control software 36 in order to determine whether fusing station 30 remains and continues to operate in the fusing mode. If mode check 220 determines that fusing station 30 and/or electrophotographic machine is operating in the fusing mode, heating roller engagement control process 110 is repeated. If mode check 220 determines that fusing station 30 and/or electrophotographic machine 20 are no longer operating in the fusing mode, heating roller engagement control process 110 terminates.

Figure 7:
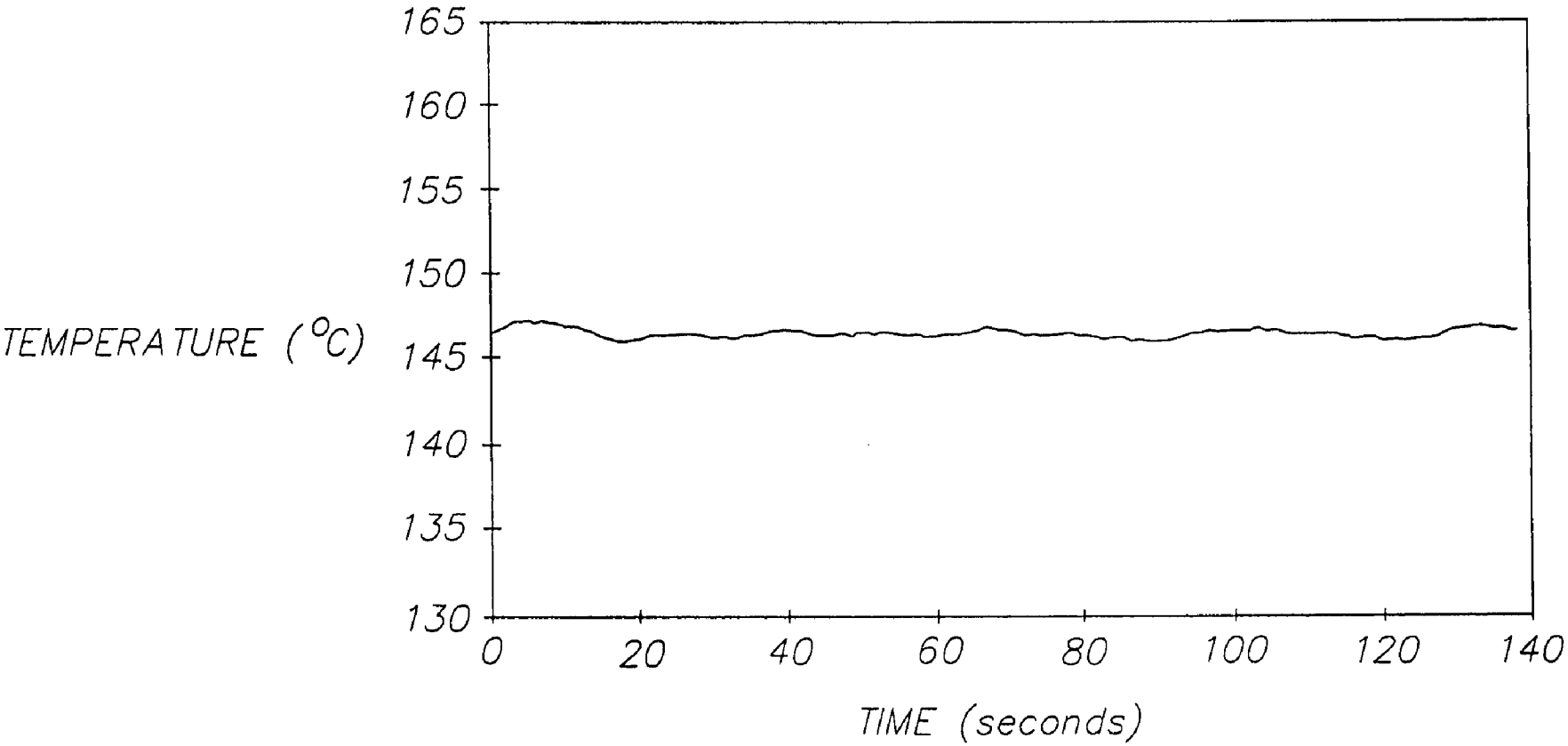
FIG. 7 is a plot of fusing roller surface temperature versus time obtained by the method for applying a modified fusing roller temperature set-point characteristic and the heating roller engagement control process of FIG. 3.

Comparing the plot of the fusing roller temperature obtained when conventional set points and control methods are applied as shown in FIG. 1 with the plot of fusing roller temperature obtained when the modified fusing roller temperature set-point characteristic and heating roller engagement control method of the present invention are applied as shown in FIG. 7, it is seen that the initial short-term dip in fusing roller temperature present in FIG. 1 is substantially reduced in FIG. 7 and that the long-term variation seen in the fusing roller temperature in FIG. 1 is also substantially reduced in FIG. 7.

In the embodiment shown, modified fusing temperature set-point characteristic (MFTSC) 10 has modified values for the fusing roller surface temperature that are generally higher than or increased relative to the nominal set points. However, it is to be understood that MFTSC 10 can be alternately configured, such as, for example, having one or more values or portions that are lower than or reduced relative to nominal.

In the embodiment shown, fusing station 30 includes two heating rollers 46 and 48. However, it is to be understood that fusing station 30 can be alternately configured, such as, for example, with a single heating roller or more than two heating rollers.

As defined herein, the beginning of a run for the purposes of the present invention includes and is defined as including the period of time during which the temperature of fusing roller 42 would, without modification of the fusing temperature characteristic, be suddenly reduced and undergo a dip similar to that shown in FIG. 1, and typically includes the time during which the first five to ten documents are processed, or approximately the first 5–10 seconds of operation of fusing station 30. It should be understood, however, that what constitutes the beginning of a run will vary dependent upon the characteristics, such as size, power, etc., of a particular electrophotographic machine and may therefore encompass a larger or smaller number of documents being processed and/or a larger or smaller duration of time than the exemplary numbers discussed herein.

While this invention has been described as having a preferred arrangement, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

PARTS LIST

10 Modified Fusing Set-Point Characteristic (MFSTC)
30 Fusing station
32 Fusing station controller
34 Memory
36 Fuser control software
38 Input/output circuitry
40 Main machine controller

42 Fusing roller
44 Pressure roller
46 Heating roller
48 Heating roller
56 Heating roller sensor
58 Heating roller sensor
62 Internal heating element
64 Fusing roller sensor
66 Heating element
68 Heating element
100 Method for applying a modified fusing roller temperature set-point characteristic and heating roller engagement control process
102 Fusing mode check
104 Setting initial fusing temperature set-points
106 Air skive control
108 Fusing temperature set-point modification process
110 Heating roller engagement control process
120 Beginning of a run check
122 Applying modified fusing temperature set-points
124 Mode monitoring process
202 Read fuser temperature
204 Calculate heating roller engagement level (HREL)
206 Minimum level check (HREL>LEVEL MIN.)
208 Maximum level check (HREL>LEVEL MAX.)
210 Update heating roller engagement level
212 Operating high limit check (HREL>HI)
214 Increase heating roller set-point
216 Operating low limit check (HREL<LOW)
218 Decrease heating roller set-point
220 Mode check
$T_{NOM}$, $T_1$, $T_2$, $T_3$ Temperatures
$T_0$, $t_1$, $t_2$Times
HR_TEMP1 Heating roller sensor signal
HR_TEMP2 Heating roller sensor signal
HR_ENG Heating roller engagement control signal
FR_TEMP Fusing roller sensor signal
HR_CTRL1 Heating roller control signal
HR_CTRL2 Heating roller control signal
FR_CTRL Fusing roller control signal
M_CTRL Main control signal
N Nip

What is claimed is:

1. An electrophotographic machine, comprising:

a fusing mechanism;

at least one heating mechanism associated with and heating said fusing mechanism;

means for applying a modified fusing set-point temperature characteristic to said fusing mechanism at a beginning of a fusing run;

a controller configured for detecting a beginning of a fusing run, said controller electrically interconnected with and receiving signals indicative of a temperature of said fusing mechanism and of said at least one heating mechanism; said controller issuing control signals to adjust the temperature of said at least one heating mechanism and an engagement level of said at least one heating mechanism with said fusing mechanism thereby controlling the temperature of said fusing mechanism; and control software executable by said controller, said control software applying the modified fusing set-point temperature characteristic to said fusing mechanism during the beginning of the fusing run.

2. The electrophotographic machine of claim 1, wherein said fusing mechanism is a fusing roller and said at least one heating mechanism is at least one heating roller, and wherein said control software further provides:

a heating roller engagement control process that includes a read fuser temperature process, a calculate heating roller engagement level process, a minimum level check process, a maximum level check process, an update heating roller engagement level process, and a mode check process.

3. The electrophotographic machine of claim 2, wherein said control software further provides:

an operating high limit check process, an increase heating roller set-point process, an operating low limit check process, and a decrease heating roller set-point process.

4. The electrophotographic machine of claim 1, wherein said modified fusing set-point temperature characteristic includes:

a first fusing roller surface temperature from a time corresponding substantially with the beginning of the fusing run to a first time;

a second fusing roller surface temperature from said first time to a second time; and a third fusing roller surface temperature subsequent to said second time.

5. The electrophotographic machine of claim 4, wherein said second fusing roller surface temperature is changed in a predetermined manner from said first time to said second time.

6. The electrophotographic machine of claim 5, wherein said third fusing roller surface temperature is approximately equal to a nominal fusing temperature.

7. The electrophotographic machine of claim 6, wherein said first fusing roller surface temperature is from approximately zero to approximately twenty degrees Celsius higher than said nominal fusing temperature.

8. The electrophotographic machine of claim 6, wherein said first fusing roller surface temperature is from approximately zero to approximately ten degrees Celsius higher than said nominal fusing temperature.

9. The electrophotographic machine of claim 6, wherein said second fusing roller surface temperature is from approximately zero to approximately twenty degrees Celsius higher than said nominal fusing temperature.

10. The electrophotographic machine of claim 6, wherein said second fusing roller surface temperature is from approximately zero to approximately ten degrees Celsius higher than said nominal fusing temperature.

11. The electrophotographic machine of claim 6, wherein said first time is from approximately 1 to approximately 30 seconds.

12. The electrophotographic machine of claim 6, wherein said second time is from approximate 1 to approximately 30 seconds.

13. In an electrophotographic machine, a method of reducing variation in the surface temperature of an externally-heated fuser that typically occurs during the beginning of a fusing run, at least one heater associated with and engaging said fuser at a heater engagement level to thereby heat said fuser, said method comprising:

detecting the beginning of a fusing run;

applying a modified fusing temperature set-point characteristic to the fuser during the beginning of a fusing run by setting the surface temperature of the fuser at a first temperature from a time corresponding substantially with the beginning of the fusing run to a first time;

setting the surface temperature of the fuser to a second surface temperature from approximately said first time until a second time;

setting the surface temperature of the fuser at a third surface temperature subsequent to said second time;

checking the mode of the electrophotographic machine to determine whether the machine remains in a fusing mode of operation; and ceasing said applying step when the electrophotographic machine is no longer operating in the fusing mode.

14. The method of claim 13, wherein said second surface temperature is changed in a predetermined manner from said first time to said second time.

15. The method of claim 14, wherein said third surface temperature is approximately equal to a nominal fusing temperature.

16. The method of claim 15, wherein said first surface temperature is from approximately zero to approximately twenty degrees Celsius higher than said nominal fusing temperature.

17. The method of claim 15, wherein said first surface temperature is from approximately zero to approximately ten degrees Celsius higher than said nominal fusing temperature.

18. The method of claim 15, wherein said second surface temperature is from approximately zero to approximately twenty degrees Celsius higher than said nominal fusing temperature.

19. The method of claim 15, wherein said second surface temperature is from approximately zero to approximately ten degrees Celsius higher than said nominal fusing temperature.

20. The method of claim 15, wherein said first time is from approximately 1 to approximately 30 seconds.

21. The method of claim 15, wherein said second time is from approximate 1 to approximately 30 seconds.

22. In an electrophotographic machine, a method of reducing variation in the surface temperature of an externally-heated fuser that typically occurs during the beginning of a fusing run, at least one heater associated with and engaging said fuser at a heater engagement level to thereby heat said fuser, said method comprising:

detecting the beginning of a fusing run;

applying a modified fusing temperature set-point characteristic to the fuser during the beginning of a fusing run by setting the surface temperature of the fuser at a first temperature from a time corresponding substantially with the beginning of the fusing run to a first time;

setting the surface temperature of the fuser to a second surface temperature from approximately said first time until a second time;

setting the surface temperature of the fuser at a third surface temperature subsequent to said second time;

checking the mode of the electrophotographic machine to determine whether the machine remains in a fusing mode of operation; and ceasing said applying step when the electrophotographic machine is no longer operating in the fusing mode;

with sensing the surface temperature of the fuser to thereby obtain a sensed surface temperature;

comparing the sensed surface temperature with a target surface temperature;

calculating an updated heater engagement value dependent at least in part upon said comparing step; and setting the heater engagement level to the updated heater engagement value.

23. The method of claim 22, including the further steps of:

comparing the calculated heater engagement value to predetermined minimum and maximum levels;

assigning the predetermined minimum level to the updated heater engagement value when the calculated heater engagement value is less than the predetermined minimum level; and assigning the predetermined maximum level to the updated heater engagement value when the calculated heater engagement value exceeds the predetermined maximum level.

24. The method of claim 23, including the further steps of:

comparing the updated heater engagement value to an operating high limit;

increasing the heater set-point temperature when the updated heater engagement value exceeds the operating high limit;

comparing the updated heater engagement value to an operating low limit; and decreasing the heater set-point temperature when the updated heater engagement value is less than the operating high limit.

25. The method of claim 24, wherein said operating high limit is less than or equal to ninety-nine percent of said maximum level.

26. The method of claim 24, wherein said operating high limit is less than or equal to ninety-five percent of said maximum level.

27. The method of claim 24, wherein said operating low limit is greater than or equal to twenty-five percent of said maximum level.

28. The method of claim 24, wherein said operating low limit is greater than or equal to eighty percent of said maximum level.

29. A method for controlling the temperature of an externally-heated fusing roller in an electrophotographic machine, said machine having at least one heating roller associated with and heating said fusing roller, by controlling the force with which the heating roller engages the fusing roller, said method comprising:

sensing the surface temperature of the fusing roller to thereby obtain a sensed surface temperature;

comparing the sensed surface temperature with a target surface temperature;

calculating an updated heating roller engagement value dependent at least in part upon said comparing step; and setting the heating roller engagement level to the updated heating roller engagement value.

30. The method of claim 29, including the further steps of:

comparing the calculated heating roller engagement value to predetermined minimum and maximum levels;

assigning the predetermined minimum level to the updated heating roller engagement value when the calculated heating roller engagement value is less than the predetermined minimum level; and assigning the predetermined maximum level to the updated heating roller engagement value when the calculated heating roller engagement value exceeds the predetermined maximum level.

31. The method of claim 30, including the further steps of:

comparing the updated heating roller engagement value to an operating high limit;

increasing the heating roller set-point temperature when the updated heating roller engagement value exceeds the operating high limit;

comparing the updated heating roller engagement value to an operating low limit; and decreasing the heating roller set-point temperature when the updated heating roller engagement value is less than the operating high limit.

32. The method of claim 31, wherein said operating high limit is less than or equal to ninety-nine percent of said maximum level.

33. The method of claim 31, wherein said operating high limit is less than or equal to ninety-five percent of said maximum level.

34. The method of claim 31, wherein said operating low limit is greater than or equal to twenty-five percent of said maximum level.

35. The method of claim 31, wherein said operating low limit is greater than or equal to eighty percent of said maximum level.

* * * * *